US011891893B2

(12) United States Patent
Heichel et al.

(10) Patent No.: US 11,891,893 B2
(45) Date of Patent: Feb. 6, 2024

(54) CIVIL ENGINEERING DEVICE

(71) Applicant: ABI Anlagentechnik-Baumaschinen-Industriebedarf Maschinenfabrik und Vertriebsgesellschaft mbH, Niedernberg (DE)

(72) Inventors: Christian Heichel, Niedernberg (DE); Tobias Schmidt, Aschaffenburg (DE)

(73) Assignee: ABI ANLAGENTECHNIK-BAUMASCHINEN-INDUSTRIEBEDARF MASCHINENFABRIK UND VERTRIEBSGESELLSCHAFT MBH, Niedernberg (DE)

( * ) Notice: Subject to any disclaimer, the term of this patent is extended or adjusted under 35 U.S.C. 154(b) by 646 days.

(21) Appl. No.: 17/113,208

(22) Filed: Dec. 7, 2020

(65) Prior Publication Data

US 2021/0230942 A1 Jul. 29, 2021

(30) Foreign Application Priority Data

Jan. 23, 2020 (EP) ..... 20153275

(51) Int. Cl.
*E21B 7/02* (2006.01)
*E02D 7/06* (2006.01)
*E02D 7/14* (2006.01)

(52) U.S. Cl.
CPC ..... *E21B 7/022* (2013.01); *E02D 7/06* (2013.01); *E02D 7/14* (2013.01); *E02D 2600/10* (2013.01)

(58) Field of Classification Search
CPC .. E21B 7/022; E02D 7/06; E02D 7/14; E02D 2600/10; E02D 7/18; E02D 7/22; E02D 13/04; E02D 13/06; E02D 7/16
See application file for complete search history.

(56) References Cited

U.S. PATENT DOCUMENTS 3,162,253 A * 12/1964 Curtis ..... E21B 7/022 173/147
7,457,698 B2 * 11/2008 Danko ..... E02F 3/439 700/262

(Continued)

FOREIGN PATENT DOCUMENTS

DE 20 2011 001 120 U1 5/2011
EP 1 655 415 A1 5/2006

(Continued)

OTHER PUBLICATIONS

Translation of WO-2020103825-A1, 15 pages (Year: 2020).*

(Continued)

*Primary Examiner* — Dale W Hilgendorf
(74) *Attorney, Agent, or Firm* — Collard & Roe, P.C.

(57) ABSTRACT

A civil engineering device, in particular a pile-driving or drilling device, has at least one positioner, in particular a working carriage for accommodating an implement, connected with a carrier device by relatively movable links within a kinematic chain and connected by joints and/or linear adjusters and with at least six actuators for changing their corresponding position and/or orientation, and with a control and regulation device for controlling them. The control and regulation device has an input module for specifying a positioner target position, and is connected with a computer module that determines at least one displacement path for moving the positioner from its current (starting) position to the target position, and, using inverse kinematics, the locations of the individual actuators required for implementing the path, and sends these locations to the control and regulation device to control the actuators. A method multi-dimensionally, free positions a civil engineering device positioner.

15 Claims, 5 Drawing Sheets

(56) References Cited

U.S. PATENT DOCUMENTS

| | | | | |
|---|---|---|---|---|
| 11,619,021 | B2 * | 4/2023 | Karl | E02D 7/16 173/206 |
| 2006/0096941 | A1 * | 5/2006 | Stoetzer | E21B 7/023 212/347 |
| 2012/0072081 | A1 * | 3/2012 | Lanzl | E21B 7/022 701/50 |
| 2013/0332875 | A1 * | 12/2013 | Heikkila | G06F 3/0484 715/771 |
| 2019/0162211 | A1 * | 5/2019 | Lyytikäinen | E02D 7/14 |
| 2022/0064891 | A1 * | 3/2022 | Kleibl | E02D 7/16 |

FOREIGN PATENT DOCUMENTS

| | | | | |
|---|---|---|---|---|
| EP | 3 584 370 | A1 | 12/2019 | |
| WO | 2017/174861 | A1 | 10/2017 | |
| WO | WO-2020103825 | A1 * | 5/2020 | E21B 44/00 |

OTHER PUBLICATIONS

European Search Report dated Aug. 7, 2020 in European Application No. 20153275.1 with English translation of the relevant parts.

* cited by examiner

CIVIL ENGINEERING DEVICE

CROSS REFERENCE TO RELATED APPLICATIONS

Applicant claims priority under 35 U.S.C. § 119 of European Application No. 20153275.1 filed Jan. 23, 2020, the disclosure of which is incorporated by reference.

BACKGROUND OF THE INVENTION

1. Field of the Invention

The invention relates to a civil engineering device, in particular to a pile-driving device or drilling device. The invention furthermore relates to a method for multi-dimensional, free positioning of a positioner of a civil engineering device.

2. Description of the Related Art

In the operation of a civil engineering device, in particular of a special civil engineering device such as a pile-driving device or drilling device, precise positioning of the implement or of other working means such as a winch or an auxiliary winch is of particular importance. Thus, for example, the clamping tongs of a pile-driving device must be spatially positioned as precisely as possible, so as to hold a sheet pile element and to subsequently place it in a defined position in the ground and to introduce it into the ground. The implement of a drilling device, for example, must also first be positioned in a defined location, so as to initiate drilling. During drilling, the earth material must be removed from the thread channels of the drill at certain intervals, and for this purpose the drilling tool must be pulled out of the borehole and subsequently must be moved to a defined position for spinning off the earth material, and then must be positioned back in the borehole once again.

Pile-driving devices have multiple degrees of freedom of movement. These degrees of freedom of movement are regularly: displacement of the chassis (wherein here, for the sake of simplification, only linear forward and backward displacement is assumed), rotation of the upper carriage, inclination of the leader (forward and back), inclination of the leader (to the left, to the right), pivoting of the leader about a vertical axis, advancing of the implement carriage, pivoting of the base arm to change the reach, linear displacement of the mast. As compared with these eight degrees of freedom, drilling devices generally have only six degrees of freedom, because pivoting of the leader about a vertical axis and linear displacement of the mast are not required.

For free spatial positioning of the implement of a special civil engineering device having six or eight degrees of freedom, an experienced operator is required, who is integrated into the special civil engineering device as an essential "control and regulation element." By means of visual detection of the position, the operator constantly performs a set-point/actual value comparison and passes control commands on to the actuators of the special civil engineering device by way of control levers. Because of the complex interconnections between the individual movement paths of the actuators, precise positioning of the implement represents an interactive procedure in which individual control processes of actuators are carried out. The individual actuators generally do not perform any linear movements in a Cartesian coordinate system, but rather perform movement curves with simultaneous variation of multiple coordinates.

Going beyond positioning of an implement (i.e. of the implement carriage), positioning of further components can also be required in the case of a special civil engineering device, for example positioning of a cable pulley over which a cable of a cable winch is guided. Hereinafter, components of the special civil engineering device that are to be positioned, such as carriages or cable pulleys, for example, will be grouped together using the term "positioner."

SUMMARY OF THE INVENTION

Against this background, the invention is based on the task of making available a civil engineering device, such as, for example, a pile-driving device or drilling device, which allows automated free spatial positioning of a positioner. These and other tasks are accomplished with a civil engineering device according to one aspect of the invention.

With the invention, a civil engineering device, in particular a special civil engineering device such as a pile-driving device, for example, is made available, which device allows automated free positioning of an implement accommodated in the device. In this regard, such a pile-driving device, in particular, has eight degrees of freedom, or such a drilling device, in particular, has six degrees of freedom (with the simplified assumption, in each instance, of a chassis that can be displaced only in linear manner). Because the control and regulation device has an input module for issuing a target position of at least one positioner, and is connected with a computer module that is set up for determining at least one displacement path, along which the positioner can be moved from its current position (starting position) to the target position, and for determining the positions of the individual actuators required for implementing the displacement path of the positioner by means of inverse kinematics, and for passing these positions on to the control and regulation device for activation of the actuators, defined positioning of a positioner is made possible merely by means of issuing a target position. As a result, the demands on the sensor and motor capabilities of the operator of the civil engineering device are reduced. It is merely necessary to issue a target coordinate; control of the individual actuators takes place by means of determining individual positions of the individual actuators with the aid of the inverse kinematics.

Inverse kinematics (also called reverse transformation) is a term from robotics. In the case of a robot, it allows a determination of the articulation angles of the arm elements using the pose (position and orientation) of the end effector. In the case of inverse kinematics, the last link of the kinematic chain, called the end effector, is moved and brought into the desired position. The other links of the chain must then assume matching positions in accordance with the degrees of freedom of their joints. Methods of inverse kinematics are sufficiently known to a person skilled in the art of the field of robotics and will therefore not be discussed further at this point.

In a further development of the invention, the computer module is set up for determining movement sequences of the individual actuators for achieving the displacement path of the implement, and for passing this information on to the control and regulation device so as to control them. In this way, targeted control of the individual actuators or also control that takes place over time, for moving the positioner to the assigned target position, is made possible.

In an embodiment of the invention, the at least one holder and/or the movement links and/or the joints and/or the linear adjusters are provided with a sensor for detection of the position and/or of the location and/or of the angle setting, which sensors are connected with the control and regulation device. As a result, continuous feedback of the actual movement state is made possible. In the present case, the term "joint" should be understood to mean connection locations between two components or movement links, which allow relative movement of these components relative to one another, in particular a pivoting movement. Linear adjusters are those connection locations that exclusively allow a linear movement between two components or movement links.

In a further development of the invention, a geometrically described model of the civil engineering device or at least a mathematical model of the system behavior of the civil engineering device or both are stored in the control and regulation device. In this way, detection of the kinematic system behavior and its regulation are simplified.

Preferably, the positioner is formed by a working carriage for holding an implement, which carriage is arranged so as to be displaceable on a leader, which is connected with the carrier device, preferably a carrier vehicle, by way of a pivoting and/or tilting apparatus.

In a further development of the invention, at least one system for detection of the work environment is provided. This system is connected with an evaluation module that is set up for determining hindrances and is connected with the computer module. The computer module is set up for determining at least one displacement path, while avoiding hindrances identified by the evaluation module. In this way, collision of a positioner, for example of a working carriage and an implement accommodated on it, with hindrances situated in the work environment is prevented. Preferably, the system for capture of the work environment has at least one camera and/or at least one ultrasound sensor and/or at least one radar sensor and/or at least one LIDAR sensor and/or at least one laser sensor. In this way, continuous, detailed capture of the work environment is made possible.

In a further embodiment of the invention, at least one camera and/or at least one ultrasound sensor and/or at least one radar sensor and/or at least one LIDAR sensor and/or at least one laser sensor is arranged on at least one positioner and/or at least one implement and/or at least one movement link connected with a positioner. In this way, gap-free capture of the work environment is made possible even in the case of the most varied movement states of the civil engineering device.

In a further embodiment of the invention, the computer module is connected with a memory module in which defined lockout regions are stored, which must be treated like hindrances in the determination of displacement paths. In this way, a restriction of possible displacement paths of the implement accommodated in a holder is made possible.

In a further embodiment of the invention, the evaluation module is set up for continuous determination of hindrances even during positioning of a positioner along a displacement path. The computer module is set up for continuous collision checking of hindrances determined along the displacement path, and, if necessary, correction of this displacement path. In this way, a collision is prevented in the case of changed situations in the surroundings.

In an advantageous embodiment, the computer module is connected with an optical and/or acoustical signal emitter and set up for activating this signal emitter in the event that a correction of the displacement path without a collision is not possible.

In a further development of the invention, the input device comprises a screen on which the current surroundings are reproduced, wherein a transformation module is provided that is set up for converting input instructions into coordinates of a predetermined coordinate system and passing these coordinates on to the control and regulation device as target coordinates. Preferably, the input device comprises a touch screen on which a target position can be input by means of touching it. Alternatively, the screen can also be an integral part of a Virtual Reality (VR) system, into which a desired target position can be input by means of defined actions, for example pointing with a finger.

In an embodiment of the invention, at least one actuator has, preferably all the actuators have, a separate actuator regulator assigned to them, by way of which regulator the corresponding actuator can be controlled on the basis of a set-point position and/or a set-point speed and/or a set-point acceleration as an input value. The actuator regulators can be specifically coordinated with the movement forms and degrees of freedom of an actuator, and thereby make easier control and regulation of the corresponding actuator possible.

In a further embodiment of the invention, the control and regulation device is set up for direct position regulation, in which the set-point positions of the joints and/or of the linear adjusters are set for the actuator regulators at the same time. In this way, accelerated positioning of a positioner, for example of a working carriage with an implement accommodated on it is made possible.

In a further embodiment of the invention, the control and regulation device is set up for cascade regulation. In this embodiment, a time-dependent speed profile with defined acceleration and speed is calculated from the target position specification, at which acceleration and speed the set-point position is supposed to be approached, and this profile is passed on to the actuator regulators. In this regard, preferably a position regulation circuit is provided for monitoring the current position, as is a regulator for the corresponding set-point position at a corresponding point in time, which results from the speed profile.

The present invention is furthermore based on the task of making available a method for multi-dimensional free positioning of a positioner of a civil engineering device, which method allows automated positioning of the positioner, for example of a working carriage with an implement accommodated on it, merely by setting a target position.

These and other tasks are accomplished by means of a method according to another aspect of the invention. For positioning of the positioner, which is connected with a carrier device by way of multiple movement links within a kinematic chain, which links can be moved relative to one another by way of joints and/or linear adjusters, wherein the movement links are connected with at least six actuators, by way of which their corresponding position and/or orientation can be changed, a displacement path is determined on the basis of a target position of the positioner, for example of the working carriage with the implement accommodated on it, on the basis of which path the joint positions of the individual joints as well as the linear positions of the linear adjusters are determined.

Furthermore, the actuator movements required for implementing the individual joint positions and linear positions are determined, and subsequently the individual actuators are controlled by means of carrying out the actuator movements that are determined.

In a further development of the invention, at least one system for capturing the work environment is provided, wherein hindrances are detected by means of an evaluation module, and wherein the determination of the displacement path takes place taking into consideration avoidance of collisions with the detected hindrances. In this way, collisions with hindrances situated in the work environment are prevented.

In an embodiment of the invention, multiple possible displacement paths are determined. Subsequently, a displacement path is selected by means of a comparison of the displacement paths determined, on the basis of predetermined parameters. These predetermined parameters include, for example, "fastest path," "shortest path," "minimal number of direction changes" or "maximal distance from point (x, y, z)." In this way, depending on the specification, a particularly fast or also a particularly gentle displacement path is made possible.

In a further embodiment of the invention, determination of the joint position of the individual joints and of the linear position of the linear adjusters takes place by means of the use of an algorithm based on inverse kinematics. Inverse kinematics, also called reverse transformation, terms that come from the field of robotics, allows determination of the joint angles of the movement links within the kinematic chain, on the basis of the position and orientation of the selected holder.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings,

FIG. 4B showing the drilling rig in the position "leader lowered"; and

FIG. 4C showing the drilling rig in the position "leader inclined";

DETAILED DESCRIPTION OF PREFERRED EMBODIMENTS

Figure 1:
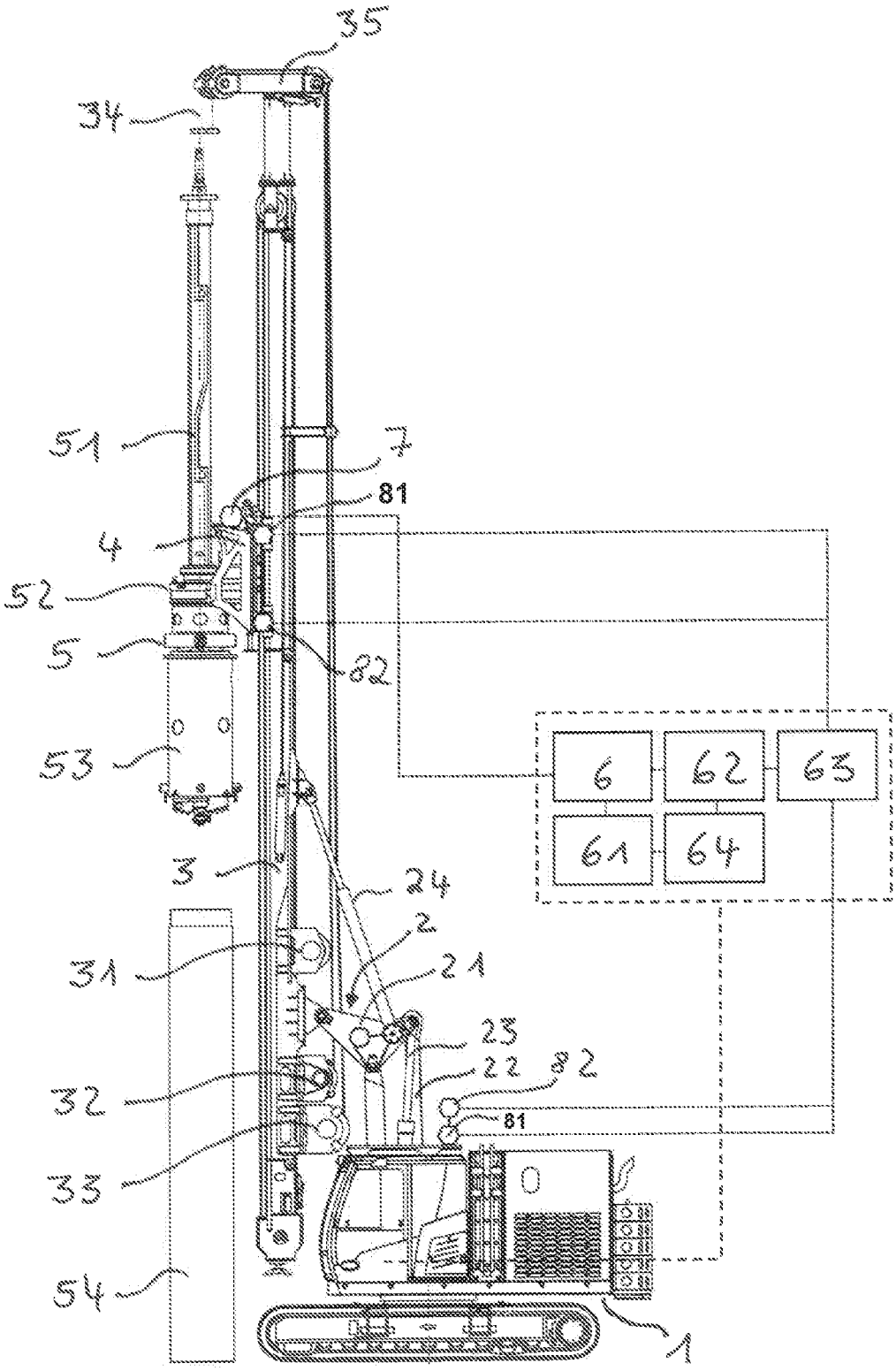
FIG. 1 shows s schematic representation of a drilling rig.

The drilling rig selected as an exemplary embodiment essentially consists of a carrier device 1, which is connected with a leader 3 by way of a swing arm 2, on which leader a working carriage 4 is arranged in displaceable manner, on which carriage a drilling device 5 is attached.

The swing arm 2 comprises two swing arm plates 21, arranged parallel to one another and configured essentially in triangular shape, with rounded corners. The swing arm plates 21 of the swing arm 2, lying opposite one another, are connected with a corner of a boom 22, in each instance, with one corner; the boom is fastened to the carrier device 1 so as to pivot. With a second corner, the swing arm plates 21, lying opposite one another, are connected with the leader 3 so as to pivot. The third corner of the swing arm plates 21 is connected with a boom cylinder 23, which is arranged on the carrier device 1. At a distance from the boom cylinder 23, in the region of the third corner of the swing arm plates 21, a support strut cylinder 24 is attached so as to pivot, in each instance; the cylinder piston of this cylinder is attached to the leader 3 so as to pivot, in each instance.

Between the swing arm plates 21 and the pistons of the support strut cylinder 24, an advancing winch 31 is arranged on the leader 3. By way of this advancing winch 31, the carriage 4 can be displaced along the leader 3. At a distance from the advancing winch 31, on the opposite side of the swing arm plates 21, an auxiliary winch 32 is arranged on the leader 3, and, at a distance from it, a Kelly winch 33 is also arranged on the leader 3. The Kelly cable 34 of the Kelly winch 33 is guided over a cable roller head 35 arranged on the leader 3, and connected with the Kelly rod 51 of the drilling device 5 on the end side. The drilling device 5, in known manner, has a drilling drive 52, as well as a pressure pipe 53 that can be connected with a drilling pipe 54.

A control and regulation device 6, which has an input module 61 for specifying a target position of the working carriage 4 as a positioner, and is connected with a computer module 62, is arranged in the carrier device 1. It can also be provided to select a specific point or a specific element of the drilling device, for example of the drilling tool of the drilling device 5 or of the cable roller head 35 that holds the Kelly cable and the auxiliary cable as a positioner for which a target position is indicated, by way of the input module. In the exemplary embodiment, the input device comprises a touch screen 66 on which the virtual environment of the drilling rig can be represented. A transformation module 67 is set up for converting input instructions into coordinates of a predetermined coordinate system and passing the coordinates on to the control and regulation device 6.

The control and regulation device 6 is connected with the boom cylinders 23, the support strut cylinders 24, the advancing winch 31, the Kelly winch 33, the auxiliary winch 32, and also (see FIG. 2) the pivoting unit of the upper carriage 11 and the travel drive of the chassis 12 of the carrier device 1, which form actuators that can be controlled by way of the control and regulation device. The position of a positioner, in the present case the working carriage 4 with the drilling device accommodated on it, can be changed by way of controlling one or more of these actuators.

By way of the actuators, positioning of the drilling device in six degrees of freedom is made possible: displacement of the chassis 12 (wherein here, for the sake of simplicity, only linear forward and reverse travel is assumed), rotation of the upper carriage 11, inclination of the leader 3 (forward and back), inclination of the leader 3 (to the left, to the right), advancing of the working carriage 4 along the leader 3, pivoting of the boom 22 that forms the base arm, to change the reach.

The control and regulation device 6 is connected with sensors 7 that are provided on the working carriage 4 for detection of position, location, and angle position. In addition, sensors 7 can be provided on further elements of the drilling device. Furthermore, the control and regulation device is connected with a computer module 62 that is set up for determining displacement paths and the positions of the individual actuators required for their implementation, by means of inverse kinematics. For this purpose, in the exemplary embodiment a geometrically described model of the drilling rig and a mathematical model of the system behavior of the drilling rig are stored in the computer module 62.

The computer module 62 is connected with an evaluation module 63 that is set up for determining hindrances and, for this purpose, is connected with a system 60 for capture of the work environment. In the exemplary embodiment, the system 60 for capture of the work environment comprises cameras 81 as well as LIDAR sensors 82, which are arranged on the carrier device 1 and on the working carriage 4, and are connected with the evaluation module 63. The system 60 for capture of the work environment may include sensors 7 such as ultrasound sensors, radar sensors, or laser sensors.

The computer module 62 is furthermore connected with a memory module 64 in which defined lockout regions are stored, which regions are to be treated like hindrances in the determination of displacement paths. Corresponding lockout regions can be defined by way of the input module 61. The computer module 62 is set up for continuous collision checking of determined and defined hindrances against determined displacement paths, and, if necessary, correction of a displacement path.

Figure 2:
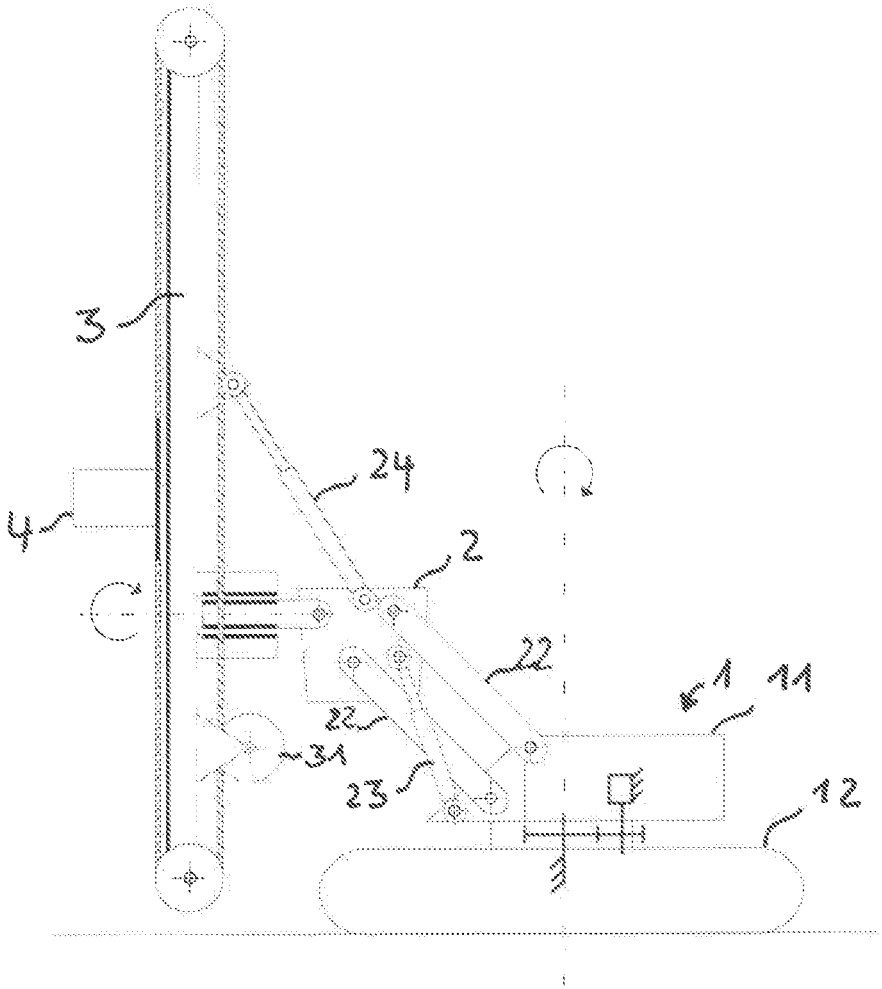
FIG. 2 shows a representation of the drilling rig from FIG. 1 in a simplified replacement representation.
Figure 3:
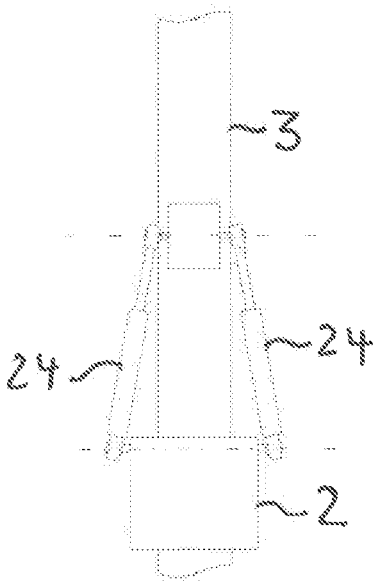
FIG. 3 shows a detail representation of the support strut cylinder arrangement of the drilling rig from FIG. 2.

In FIG. 2, a simplified illustration of the drilling rig is shown, in which the significant functional components for positioning the working carriage 4 are shown. The location of the leader 3, with the working carriage 4 arranged on it in displaceable manner, can be changed by way of the position of the swing arm 2, which is connected with the upper carriage 11 of the carrier device 1 by way of the booms 22. The booms 22 form movement links that are connected with the swing arm 2 and with the upper carriage 11 of the carrier device 1 by way of joints, so as to pivot about a horizontal axis. The swing arm 2 is compulsorily guided by way of the booms 22 and can be moved along a curve path by way of the boom cylinders 23. The booms 22 and the boom cylinders 23 can be pivoted about a vertical axis together with the upper carriage 11, on the chassis 12. They can be displaced horizontally, in linear manner, by means of the chassis 12.

The leader 3 is connected with the swing arm 2 by way of joints, so as to pivot about two horizontal axes. Setting of the pivot position of the leader 3 on the swing arm 2 takes place by way of the support strut cylinders 24, which are connected with the leader 3 and with the swing arm 2 by way of joints, so as to pivot about two horizontal axes. Positioning of the working carriage 4, which is connected with the leader 3 by way of a linear adjuster, takes place by way of linear displacement along the leader 3, by way of the advancing winch 31.

Figure 4A:
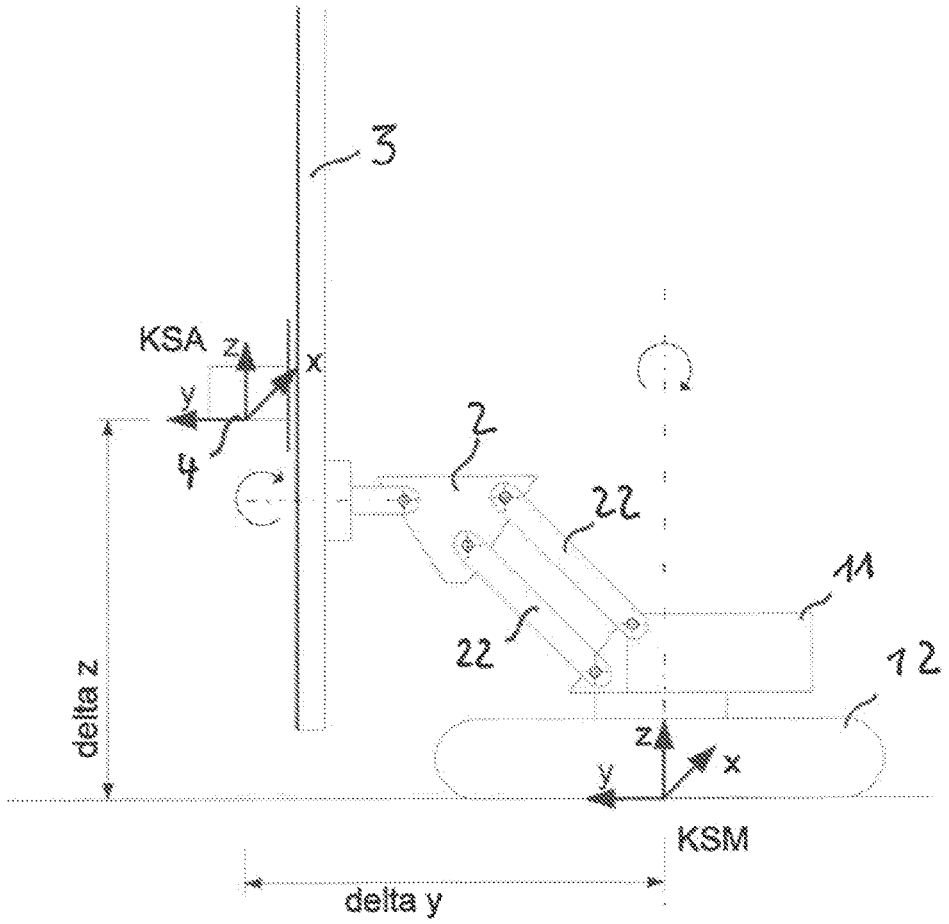
FIGS. 4A-4C show further simplified replacement representations of the drilling rig from FIG. 2 with FIG. 4A showing the drilling rig in the position "leader raised"
Figure 4B:
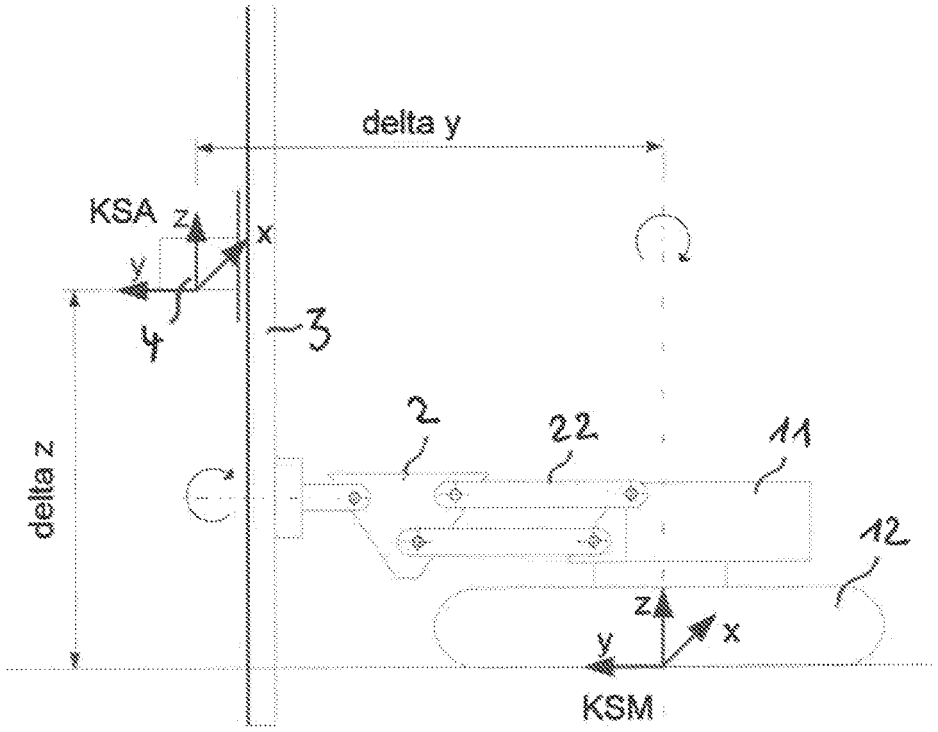
Figure 4C:
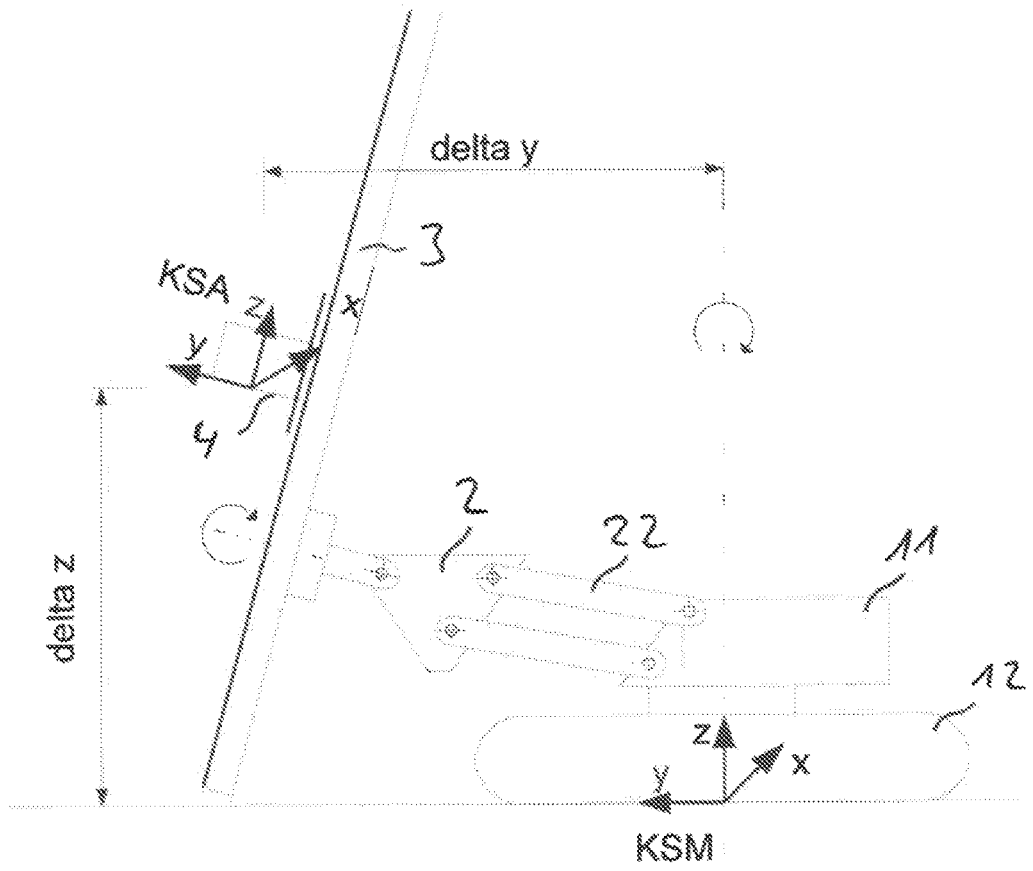

In FIGS. 4A-4C, "KSA" designates the coordinate system for the attachment and "KSM" designates the coordinate system for the machine. In FIG. 4A, this diagram is shown with further simplification, without the boom cylinder 23, the support strut cylinders 24, and the advancing winch 31, to illustrate the kinematics. In FIG. 4B, lowering of the base arm formed by the booms 22 is shown as an example. In this regard, the working carriage 4 moves on a circular track about the point of rotation of the booms 22. As a result, the working carriage 4 experiences changes in position by means of increasing the distance from the carrier device 1 (increasing the reach) and, at the same time, a change in position due to decreasing the distance from the ground. If only the horizontal position of the working carriage 4 (delta y) is supposed to be changed during lowering of the booms 22, whereas its vertical position (delta z) is supposed to remain the same, the working carriage 4 must be moved upward in linear manner, along the leader 3, by way of the advancing winch 31, for equalization of the vertical change in position. In FIG. 4C, in addition the leader 3 is set at an angle to the ground by way of the support strut cylinders 24. As a result, the horizontal and also the vertical position of the working carriage 4 are changed.

Figure 5:
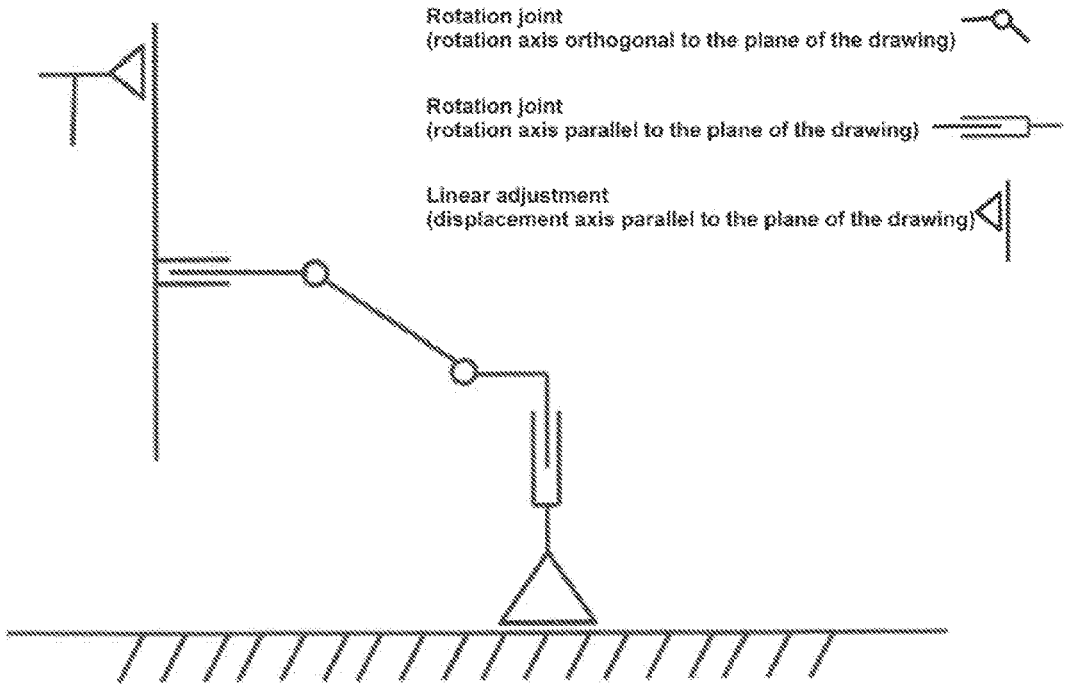
FIG. 5 shows a representation of a simplified joint diagram of the drilling rig from FIG. 2.

In FIG. 5, the kinematic chain of the arrangement from FIG. 4 is shown, which is composed of movement links connected by way of joints and linear adjusters. According to this arrangement, the six degrees of freedom indicated above for positioning of the drilling device 5 arranged on the working carriage 4 occur in the present case.

Mathematically, positioning of a positioner, used as a basis in the form of a defined point, in the present case of the working carriage 4, which holds the drilling device 5, is depicted by means of the basic principle of an inverse kinematographic algorithm in the control and regulation device. In this regard, the set-point position of this point relative to a selected basic coordinate system, for example of the carrier device, is passed on to the algorithm. Then the set-point values of the individual actuators for the desired positioning are calculated by way of algebraic, geometric, and numeric methods. Direct position variables for the actuators can result as the output of the algorithm. Derivations of the position variables over time, for example speed or acceleration, can also be used. Algorithms of inverse kinematics are known from the sectors of machine tool construction and of robotics, for positioning in the case of complex joint relationships. A position regulation circuit 68 monitors current position and adjusts the set-point position corresponding to the current position at a corresponding point in time resulting from a time-dependent profile.

For simplification of the system design, separate regulation modules, which are referred to as actuator regulators 65, are programmed for individual joints and linear adjusters, in the control and regulation device 6 and in the computer module 62 connected with this device. These modules, in which the particularities of the corresponding joint or linear adjuster or of the actuator connected with it are taken into consideration, are given a set-point position or a set-point speed as an input value.

Figure 6:
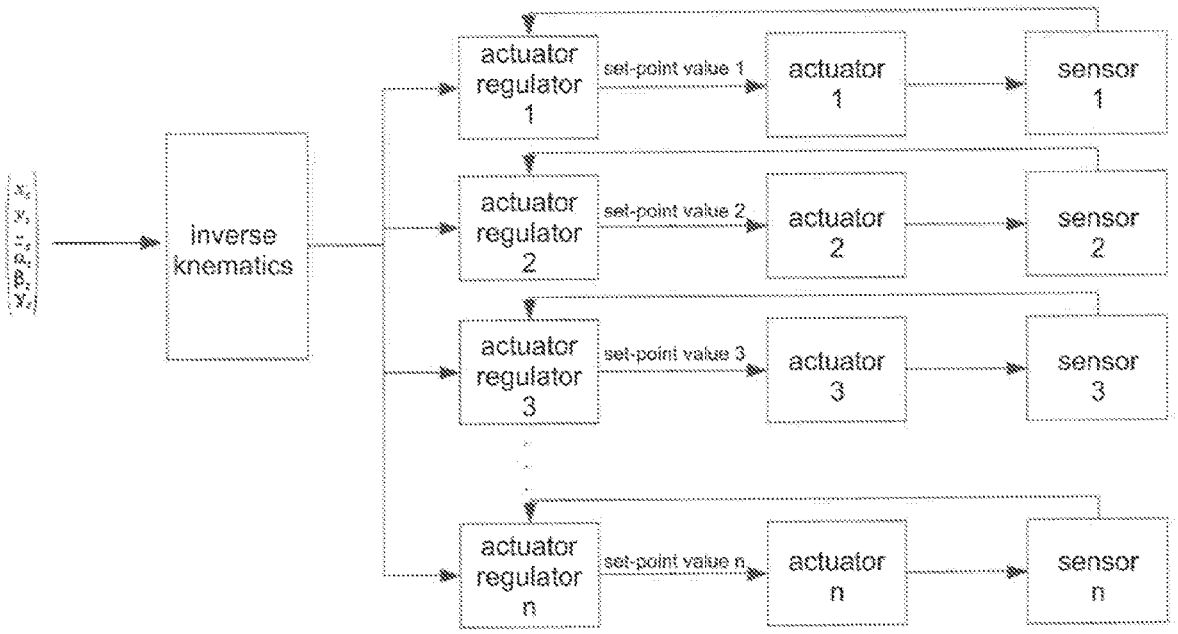
FIG. 6 shows a schematic representation of the position regulation of the control and regulation device of the drilling rig from FIG. 1, connected with the computer module.

The location regulation of the positioner is outlined in FIG. 6. The set-point positions of the joints and linear adjusters are given to the actuator regulators at the same time. By way of a PID (Proportional-Integral-Differential) regulator, the individual actuators are regulated, and thereby the system is regulated to the predetermined set-point position. In this regard, the positioning times of the individual actuators can differ greatly.

If the drilling device is supposed to be placed closer to the carrier device 1, for example, the base arm formed by the booms 22 must move up at the same time, and the advancing winch 31 must move down. Because advancing brings with it higher displacement speeds than the base arm, a default value is given by the slowest actuator. The maximum speed of all the actuators is known. Before positioning, it can be calculated how much time the slowest actuator requires as a maximum. With this time value, the speed value and acceleration value is adapted in linear manner for all the other actuators, so that these values require the same time. As a result, unnecessarily high speeds and accelerations are prevented. At the same time, simultaneous positioning of all the joints is made possible.

When using the Kelly drilling method, it is necessary, for example, to pull the drilling tool out of the borehole in regular cycles and to position it in a suitable location for spin-off. For this purpose, the operator selects a target position of the drilling device by way of the touch screen of the input module, and this position is passed on to the computer module as coordinates. On the basis of these coordinates, the computer module determines possible displacement paths. For this purpose, the input module detects hindrances on the basis of real-time data transmitted by the cameras 81 and the sensors 82, and these are passed on to the computer module.

On the basis of previously established selection criteria, such as, for example, minimized number of direction changes or fastest path, a displacement path is selected by the computer unit.

Subsequently, the computer module determines the joint positions and linear adjuster positions and the actuator movements required for them, over time, by using algorithms of inverse kinematics, and passes them on to the control and regulation device, which undertakes control of the actuators (boom cylinder 23, support strut cylinder 24, advancing winch 31, pivot drive of the upper carriage 11, chassis 12) for implementing the displacement path determined for spin-off from the drilling tool.

In the exemplary embodiment, return movement of the drilling tool to the borehole can be triggered on the same displacement path, by way of the input module.

Although only a few embodiments of the present invention have been shown and described, it is to be understood that many changes and modifications may be made thereunto without departing from the spirit and scope of the invention.

What is claimed is:

1. A civil engineering device comprising:

(a) a carrier device;

(b) a kinematic chain comprising a plurality of movement links movable relative to one another and connected by way of joints or linear adjusters;

(c) at least one positioner connected with a carrier device by way of the plurality of movement links;

(d) at least six actuators connected with the plurality of movement links for changing a corresponding position or orientation of the at least six actuators;

(e) a control computer connected with the plurality of movement links for controlling the at least six actuators; and (f) a computer module connected with the control computer;

wherein the control computer has an input module for specifying a target position of the at least one positioner; and wherein the computer module is set up for determining at least one displacement path for moving the at least one positioner along the at least one displacement path from a current position to the target position, and, using inverse kinematics, for determining locations of each actuator of the at least six actuators required for implementing the at least one displacement path of the at least one positioner and for passing location information on to the control computer so as to control the at least six actuators.

2. The civil engineering device according to claim 1, wherein the computer module is set up for determining movement sequences of the individual actuators for achieving the at least one displacement path of the positioner, and for transferring movement sequence information to the control computer for control of the at least six actuators.

3. The civil engineering device according to claim 1, wherein the at least one positioner or the plurality of movement links or the joints or the linear adjusters are provided with a sensor connected with the control computer for detection of a position or a location or an angle position.

4. The civil engineering device according to claim 1, wherein a geometrically descriptive model of the civil engineering device or at least one mathematical model of system behavior of the civil engineering device is stored in a memory of the control computer or in a memory of the computer module.

5. The civil engineering device according to claim 1, further comprising a pivoting or tilting apparatus and a leader connected with the carrier device by way of the pivoting or tilting apparatus, wherein the at least one positioner comprises a working carriage arranged on the leader in displaceable manner for accommodating an implement.

6. The civil engineering device according to claim 1, further comprising at least one system for capture of a work environment, wherein the at least one system for capture of the work environment comprises at least one camera or at least one ultrasound sensor or at least one radar sensor or at least one LIDAR sensor or at least one laser sensor.

7. The civil engineering device according to claim 6, wherein the at least one camera or the at least one ultrasound sensor or the at least one radar sensor or the at least one LIDAR sensor or the at least one laser sensor is arranged on the at least one positioner or on the one implement or on at least one movement link of the plurality of movement links connected with the at least one positioner.

8. The civil engineering device according to claim 1, further comprising a memory module connected with the computer module, wherein the memory module stores defined lockout regions to be treated like hindrances when the computer module determines the at least one displacement path.

9. The civil engineering device according to claim 1, wherein the input module comprises a screen reproducing current surroundings.

10. The civil engineering device according to claim 1, wherein at least one actuator of the at least six actuators has a separate actuator regulator assigned to the at least one actuator for controlling the at least one actuator based on a set-point position or a set-point speed or a set-point acceleration as an input value.

11. The civil engineering device according to claim 10, wherein the control computer is set up for direct location regulation and simultaneous specification to the actuator regulator of the set-point position of the joints or of the linear adjusters.

12. The civil engineering device according to claim 10, wherein the at least one actuator is controlled based on the set-point position, wherein the control computer is set up for cascade regulation, wherein a time-dependent speed profile with defined acceleration and speed is calculated from a target position specification for approaching the set-point position at the defined acceleration and speed, and wherein the time-dependent speed profile is passed on to the actuator regulator assigned to the at least one actuator.

13. A method for multi-dimensional, free positioning of a positioner of a civil engineering device, comprising:

(a) providing the civil engineering device comprising a carrier device, a kinematic chain comprising a plurality of movement links movable relative to one another by way of a plurality of joints and linear adjusters, the positioner, wherein the positioner is connected with the carrier device by way of the plurality of movement links, and at least six actuators connected with the plurality of movement links or the linear adjusters for changing a respective position or orientation of each of the at least six actuators;

(b) determining a displacement path based on a target position of the positioner;

(c) determining using an algorithm based on inverse kinematics individual joint positions of individual joints of the plurality of joints and linear positions of the linear adjusters based on the displacement path to implement actuator movements required for the individual joint positions and the linear positions; and (d) subsequently controlling individual actuators of the at least six actuators to carry out the actuator movements determined.

14. The method according to claim 13, further comprising:

providing at least one system for capture of a work environment;

detecting hindrances using the algorithm based on inverse kinematics; and determining the displacement path taking into consideration collision avoidance with the hindrances detected.

15. A method for multi-dimensional, free positioning of a positioner of a civil engineering device, comprising:

(a) providing the civil engineering device comprising a carrier device, a kinematic chain comprising a plurality of movement links movable relative to one another by way of a plurality of joints and linear adjusters, the positioner, wherein the positioner is connected with the carrier device by way of the plurality of movement links, and at least six actuators connected with the plurality of movement links or the linear adjusters for changing a respective position or orientation of each of the at least six actuators;

(b) determining a plurality of displacement paths based on a target position of the positioner;

(c) subsequently selecting a displacement path by comparison of the plurality of possible displacement paths based on predetermined parameters;

(d) determining individual joint positions of individual joints of the plurality of joints and linear positions of the linear adjusters based on the displacement path to implement actuator movements required for the individual joint positions and the linear positions; and (e) subsequently controlling individual actuators of the at least six actuators to carry out the actuator movements determined.

* * * * *